United States Patent [19]

Chessmore et al.

[11] 4,199,435

[45] Apr. 22, 1980

[54] $NO_x$ CONTROL IN CRACKING CATALYST REGENERATION

[75] Inventors: Donald O. Chessmore, Pleasant Hill; Charles E. Rudy, Jr., El Cerrito, both of Calif.

[73] Assignee: Chevron Research Company, San Francisco, Calif.

[21] Appl. No.: 965,979

[22] Filed: Dec. 4, 1978

[51] Int. Cl.[2] ..... C10G 11/04; B01J 8/24; B01J 23/94

[52] U.S. Cl. ..... 208/113; 208/118; 208/120; 208/124; 252/411 R; 252/420; 423/239

[58] Field of Search ..... 208/118, 113, 120–122, 208/124; 252/411–418, 420; 423/239

[56] References Cited

U.S. PATENT DOCUMENTS

| | | | |
|---|---|---|---|
| 3,615,166 | 10/1971 | Hindin et al. | 252/462 |
| 3,788,977 | 1/1974 | Dolbear et al. | 208/120 |
| 3,806,582 | 4/1974 | Acres et al. | 423/239 |
| 3,808,121 | 4/1974 | Wilson | 208/113 |
| 4,039,622 | 8/1977 | Murrell et al. | 423/239 |
| 4,053,556 | 10/1977 | Acres | 423/239 |
| 4,093,535 | 6/1978 | Schwartz | 208/120 |
| 4,115,250 | 9/1978 | Flanders et al. | 208/120 |
| 4,134,860 | 1/1979 | Hindin et al. | 252/472 X |
| 4,148,751 | 4/1979 | Hemler et al. | 252/419 |

*Primary Examiner*—Delbert E. Gantz
*Assistant Examiner*—G. E. Schmitkons
*Attorney, Agent, or Firm*—D. A. Newell; R. H. Davies; W. D. Reese

[57] ABSTRACT

The amount of $NO_x$ formed during regeneration of a cracking catalyst in the presence of a metallic carbon monoxide combustion catalyst is decreased without substantially adversely affecting the carbon monoxide combustion activity of the promoter by subjecting the combustion-promoting catalyst to steam treatment prior to employing it in the cracking catalyst regeneration operation.

6 Claims, 1 Drawing Figure

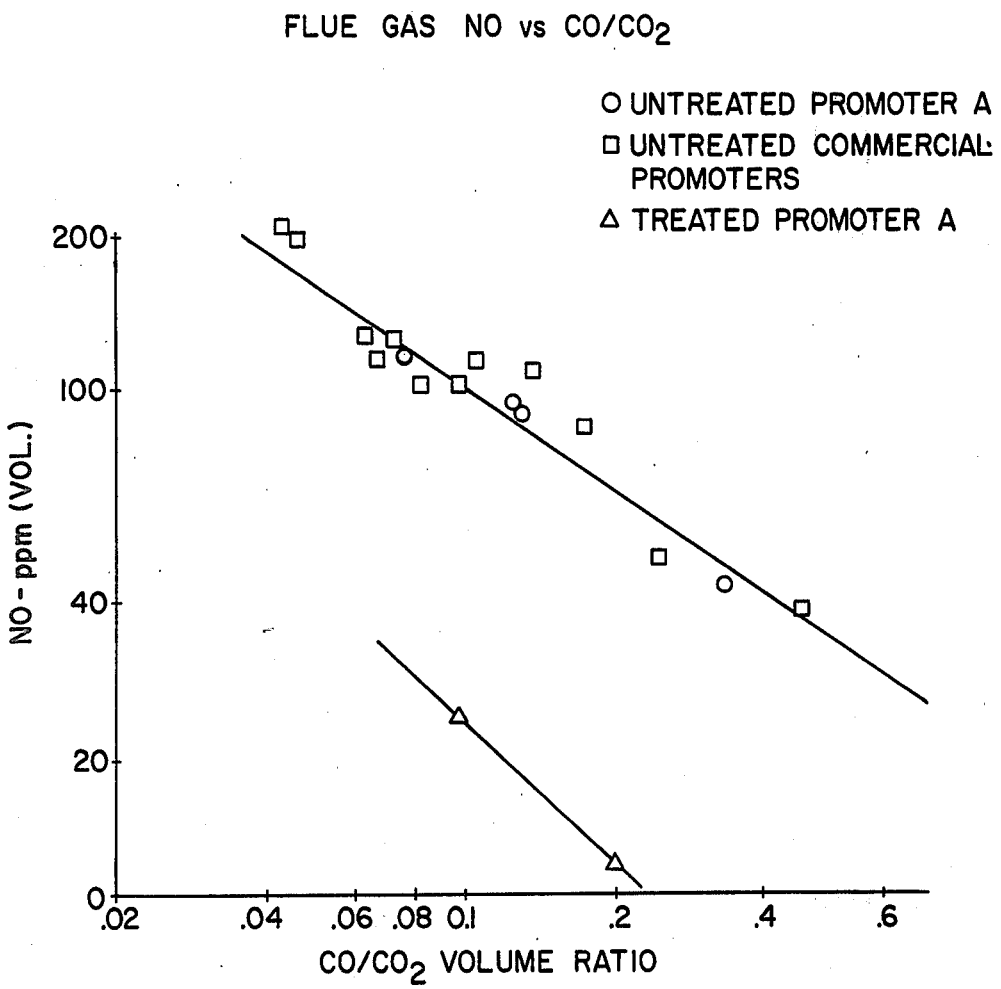
FLUE GAS NO vs CO/CO2
O UNTREATED PROMOTER A
□ UNTREATED COMMERCIAL PROMOTERS
△ TREATED PROMOTER A
200
100
40
20
0
NO - ppm (VOL.)
.02
.04
.06
.08
0.1
.2
.4
.6
CO/CO2 VOLUME RATIO

$NO_x$ CONTROL IN CRACKING CATALYST REGENERATION

BACKGROUND OF THE INVENTION

The present invention relates to a method for restricting formation of nitrogen oxides in catalyst regenerators in hydrocarbon catalytic cracking systems.

Modern hydrocarbon catalytic cracking systems use a moving bed or fluidized bed of a particulate catalyst. Catalytic cracking differs from hydrocracking in that it is carried out in the absence of externally supplied molecular hydrogen. The cracking catalyst is subjected to a continuous cyclic cracking reaction and catalyst regeneration procedure. In a fluidized catalytic cracking (FCC) system, a stream of hydrocarbon feed is contacted with fluidized catalyst particles in a hydrocarbon cracking zone, or reactor, usually at a temperature of about 425°-600° C. The reactions of hydrocarbons in the hydrocarbon stream at this temperature result in deposition of carbonaceous coke on the catalyst particles. The resulting fluid cracked hydrocarbons and other vapors are separated from the coked catalyst and are withdrawn from the cracking zone. The coked catalyst is stripped of volatiles and cycled to a catalyst regeneration zone. In the catalyst regenerator, the coked catalyst is contacted with a gas, such as air, which contains a predetermined concentration of molecular oxygen to burn off a desired portion of the coke from the catalyst and simultaneously to heat the catalyst to a high temperature desired when the catalyst is again contacted with the hydrocarbon stream in the cracking zone. After regeneration, the catalyst is cycled to the cracking zone, where it is used to vaporize the hydrocarbons and to catalyze hydrocarbon cracking. The flue gas formed by combustion of coke in the catalyst regenerator is removed from the regenerator, and may be treated to remove particulates and carbon monoxide from it, after which it is normally passed into the atmosphere. Concern with control of pollutants in flue gas has resulted in a search for improved methods for controlling such pollutants. In the past, concern has centered on sulfur oxides and carbon monoxide. Nitrogen oxides have recently become a problem, at least partly because of the increased use of newer catalyst regeneration technology, e.g., use of platinum-containing carbon monoxide combustion promoters to catalyze carbon monoxide burning.

The older, conventional type of FCC catalyst regeneration currently used in many FCC systems is an incomplete combustion mode. In such systems, referred to herein as "standard regeneration" systems, a substantial amount of coke carbon is left on regenerated catalyst passed from the FCC regeneration zone to the cracking zone. This may be, for example, a concentration of more than 0.2 weight percent carbon, usually about 0.25 to 0.45 weight percent carbon. The flue gas removed from an FCC regenerator operating in a standard regeneration mode is also characterized by a relatively high carbon monoxide/-carbon dioxide concentration ratio. The atmosphere in much or all of the regeneration zone is, over-all, a reducing atmosphere because of the presence of substantial amounts of unburned coke carbon and carbon monoxide.

Several methods have been suggested for burning substantially all carbon monoxide to form carbon dioxide during cracking catalyst regeneration, in order to avoid air pollution by carbon monoxide in the flue gas, to recover heat, and to prevent afterburning. Among the procedures suggested for use in obtaining complete carbon monoxide combustion in an FCC regenerator have been: increasing the amount of oxygen introduced into the regenerator relative to standard regeneration; and either substantially increasing the average operating temperature in the regenerator or including various carbon monoxide oxidation promoting metals in the system to promote carbon monoxide burning in the regenerator. Combustion-promoting metals have been employed in two ways: (a) on essentially all of the catalyst, i.e., in low concentrations on essentially all the particulate solids circulating in the cracking system; or (b) on a small amount of combustion-promoter particles, i.e., in high concentrations on only a very small fraction (e.g., less than 1%) of the particulate solids in the cracking system. Various solutions have also been suggested for the sometimes-related problem of afterburning of carbon monoxide. These solutions include addition of extraneous combustibles or use of water or heat-accepting solids such as catalyst to absorb the heat of combustion of carbon monoxide when the heat is released after the flue gas leaves the dense catalyst phase.

Complete combustion regeneration systems using a high temperature in the catalyst regenerator, rather than a combustion-promoting catalyst, to accomplish complete carbon monoxide combustion have been commercially employed. Much of the CO combustion takes place in a dilute catalyst phase in an after-burning mode, so that (1) much of the heat generated by carbon monoxide combustion is lost in the flue gas rather than being absorbed in the catalyst, and (2) high temperatures are generated, with the possibility of a permanent adverse effect on the activity and selectivity of catalyst exposed to the dilute-phase gas.

Because of activity limitations, promoting metals, such as platinum, are incorporated into particulate solids in relatively high concentrations, e.g., 0.01 to 1 weight percent, when the metal-promoted particles constitute only a small fraction (e.g., less than 1%) of the total solids inventory in a cracking system.

When using carbon monoxide combustion-promoting metals, such as platinum, associated with a small fraction of the total particulate solids inventory, essentially complete carbon monoxide combustion has been obtained commercially. Low levels of coke on regenerated catalyst, another desirable result, have also been obtained. On the other hand, the amount of undesirable nitrogen oxides formed in the regenerator flue gas has substantially increased in catalyst regenerators using combustion-promoting promoting metals contained on a small fraction of the circulating particulate solids. This has created an air pollution problem in disposing of the regenerator flue gas. Use of combustion promoters comprising only a small fraction of the total solids inventory in a cracking system is nevertheless often preferable to use of a small amount of promoting metal on a large fraction of the solids. This is because of the operating flexibility obtainable when using a small amount of combustion-promoting additive particles. For example, use of the additive can be discontinued rapidly without removing a large portion of the catalyst inventory from circulation in a unit.

Several modes of addition of Group VIII noble metals and other carbon monoxide combustion-promoting metals to FCC systems have been suggested in the art.

In U.S. Pat. No. 2,647,860 it is proposed to add 0.1–1 weight percent chromic oxide to an FCC catalyst to promote combustion of carbon monoxide to carbon dioxide and to prevent afterburning. U.S. Pat. No. 3,364,136 proposes to employ particles containing a small-pore (3–5 A.) molecular sieve with which is associated a transition metal from Groups IB, IIB, VIB, VIIB and VIII of the Periodic Table, or compounds thereof, such as a sulfide or oxide. Representative metals disclosed include chromium, nickel, iron, molybdenum, cobalt, platinum, palladium, copper and zinc. The metal-loaded, small-pore zeolite may be used in an FCC system in physical mixture with cracking catalysts containing larger-pore zeolites active for cracking, or the small-pore zeolite may be included in the same matrix with zeolites active for cracking. The small-pore, metal-loaded zeolites are suggested for the purpose of increasing the $CO_2/CO$ ratio in the flue gas produced in the FCC regenerator. In U.S. Pat. No. 3,788,977, it is proposed to add uranium or platinum impregnated on an inorganic oxide such as alumina to an FCC system, either in physical mixture with FCC catalyst or incorporated into the same amorphous matrix as a zeolite used for cracking. Uranium or platinum is added for the purpose of producing gasoline fractions having high aromatics contents, and the effect on carbon monoxide combustion when using the additive is not discussed in the patent. In U.S. Pat. No. 3,808,121 it is proposed to supply large-size particles containing a carbon monoxide combustion-promoter metal in an FCC regenerator. The smaller-size catalyst particles are cycled between the FCC cracking reactor and the catalyst regenerator, while, because of their size, the larger promoter particles remain in the regenerator. Carbon monoxide oxidation promoters such as cobalt, copper, nickel, manganese, copper chromite, etc., impregnated on an inorganic oxide such as alumina are disclosed for use. Belgian patent publication No. 820,181 (Schwartz, Equivalent to U.S. Pat. No. 4,093,535) suggests using catalyst particles containing platinum, palladium, iridium, rhodium, osmium, ruthenium or rhenium or mixtures or compounds thereof to promote carbon monoxide oxidation in an FCC catalyst regenerator. An amount between a trace and 100 ppm of the active metal is added to FCC catalyst particles by incorporation during catalyst manufacture or by addition of a compound of the metal to the hydrocarbon feed to an FCC unit using the catalyst. The publication asserts that addition of the promoter metal increases coke and hydrogen formation during cracking. The catalyst containing the promoter metal can be used as such or can be added in physical mixture with unpromoted FCC cracking catalyst.

U.S. Pat. Nos. 4,072,600 and 4,093,535 disclose the use of combustion-promoting metals in catalytic cracking systems in concentrations of 0.01 to 50 ppm, based on total catalyst inventory.

SUMMARY OF THE INVENTION

In one embodiment, the present invention relates to a process for cracking hydrocarbons in the absence of externally supplied molecular hydrogen comprising:

(1) contacting steam with a carbon monoxide combustion promoter comprising a combustion-promoting metal or compound of a metal selected from platinum, palladium, iridium, osmium, ruthenium, rhodium, rhenium and copper associated with at least one particulate porous inorganic solid at a temperature of 760° C. to 1100° C. and a steam pressure of 1 atmosphere to 15 atmospheres for a period of from 2 hours to 100 hours;

(2) cycling particulate cracking catalyst between a cracking zone and a catalyst regeneration zone, in a catalytic cracking system;

(3) cracking the hydrocarbons in contact with the catalyst at cracking conditions in the cracking zone whereby coke is formed on the catalyst; and (4) burning coke off the catalyst with an oxygen-containing and nitrogen-containing gas at regeneration conditions in the regeneration zone in the presence of the combustion promoter.

In another aspect, the present invention relates to a method for restricting the formation of nitrogen oxides formed in a hydrocarbon cracking catalyst regeneration zone wherein carbon monoxide is combusted with a molecular oxygen-containing and molecular nitrogen-containing gas in contact with a carbon monoxide combustion promoter including a combustion-promoting metal or compound of a metal selected from platinum, palladium, iridium, osmium, ruthenium, rhodium, rhenium and copper associated with at least one particulate porous inorganic solid, comprising:

contacting the combustion promoter with steam at a temperature of 760° C. to 1100° C. and a steam pressure of 1 atmosphere to 15 atmospheres for a period of from 2 hours to 100 hours.

We have found that the formation of nitrogen oxides encountered in previous commercial use of combustion-promoting metals contained in a small fraction of the particles in a particulate solids inventory in a cracking system can be restricted without substantially adversely affecting the carbon monoxide combustion-promoting properties of the promoter by subjecting the combustion promoter to a steam treatment prior to using the promoter in the cracking system. The steam treatment results in a slight loss of catalytic activity for carbon monoxide combustion promotion, but, surprisingly, the activity of the promoter for undesirable formation of $NO_x$ is reduced to a much greater degree than is combustion activity.

THE DRAWING

The attached drawing shows a graphical representation of the results of comparative tests made to illustrate the beneficial effect of the steam treatment of the present invention.

DETAILED DESCRIPTION OF THE INVENTION

The present invention is used in connection with a fluid catalyst cracking process for cracking hydrocarbon feeds. The same hydrocarbon feeds normally processed in commercial FCC systems may be processed in a cracking system employing the present invention. Suitable feedstocks include, for example, petroleum distillates or residuals, either virgin or partially refined. So-called synthetic feeds such as coal oils, bitumen and shale oils are also suitable. Suitable feedstocks normally boil in the range from about 200°–600° C. or higher. A suitable feed may include recycled hydrocarbons which have already been subjected to cracking.

The cracking catalyst employed may be a conventional particulate acidic cracking catalyst, such as silica-alumina. The catalyst may, for example, be a conventional non-zeolitic cracking catalyst containing at least one porous inorganic oxide, such as silica, alumina, magnesia, zirconia, titania, etc., or a mixture of silica and alumina or silica and magnesia, etc, or a clay or acid-treated clay or the like. The catalyst may also be a conventional zeolite-containing cracking catalyst including a zeolitic crystalline aluminosilicate associated with a porous refractory matrix which may be, for example, silica-alumina. The matrix generally constitutes 70–95 weight percent of the cracking catalyst, with the remaining 5–30 weight percent being a zeolite component dispersed on or embedded in the matrix. The zeolite may be rare earth-exchanged or hydrogen-exchanged. Conventional zeolite-containing cracking catalysts often include an X-type zeolite or a Y-type zeolite. Low (less than 1%) sodium content Y-type zeolites are particularly good. As will be apparent to those skilled in the art, the composition of the acidic cracking component in the catalyst particles employed in the system is not a critical feature of the present method except for optional presence of the promoting metal (discussed below) in embodiments in which the promoting metal is associated with catalyst particles. Thus, the catalyst particles may be either completely amorphous or partly amorphous and partly crystalline.

Cracking conditions employed in the cracking or conversion step in an FCC system are frequently provided in part by pre-heating or heat-exchanging hydrocarbon feeds to bring them to a temperature of about 315°–400° C. before introducing them into the cracking zone; however, pre-heating of the feed is not essential. Cracking conditions normally include a catalyst/hydrocarbon weight ratio of about 3–10. A hydrocarbon weight space velocity in the cracking zone of about 5–50 per hour is preferably used. The average amount of coke contained in the catalyst after contact with the hydrocarbons in the cracking zone, when the catalyst is passed to the regenerator, is preferably between about 0.5 weight percent and about 2.5 weight percent, depending in part on the carbon content of regenerated catalyst in the particular system, as well as the heat balance of the particular system.

The catalyst regeneration zone used in an FCC system employing an embodiment of the present invention may be of conventional design. The gaseous atmosphere within the regeneration zone normally includes a mixture of gases in concentrations which vary according to the locus within the regenerator. The concentrations of gases also vary according to the coke concentration on catalyst particles entering the regenerator and according to the amount of molecular oxygen and steam passed into the regenerator. Generally, the gaseous atmosphere in a regenerator contains 5–25% steam, varying amounts of oxygen, carbon monoxide, carbon dioxide and nitrogen. The present invention is applicable in cases in which an oxygen-containing and nitrogen-containing gas, such as air, is employed for combustion of coke in the catalyst regenerator. As will be appreciated by those skilled in the art, air is almost invariably employed to provide some or all of the oxygen needed for combustion in FCC regenerators.

A combustion-promoting metal is employed in carrying out the method of the present invention. The combustion-promoting metals which are suitable for use include one or more of the metals platinum, palladium, iridium, rhodium, osmium, ruthenium, rhenium and copper or compounds thereof, such as the oxides, sulfides, sulfates, etc. At least one of these metals or metal compounds is used, and mixtures of two or more of the metals are also suitable. For example, mixtures of platinum and palladium are suitable. The effect of the above-mentioned carbon monoxide combustion-promoter metals may be enhanced by combining them with small amounts of other metals or metalloids, particularly tin, germanium or lead.

The promoting metal or metal compound is associated with a particulate solid inorganic oxide which may be: (1) a portion of the particulate cracking catalyst; (2) a particulate solid other than the catalyst, e.g., a finely divided, porous inorganic oxide, such as alumina, silica, etc., sized suitably for circulation in an FCC system; (3) both cracking catalyst particles and another finely divided solid physically mixed and circulated with the catalyst particles; (4) a particulate solid which remains in the catalyst regenerator rather than circulating through the cracking system with the particulate solids inventory.

The total concentration of the combustion-promoting metal, or metals, or compounds thereof used in the cracking system, with respect to the circulating catalyst inventory, is sufficient to promote the desired amount of combustion of coke on the catalyst and to promote the desired amount of combustion of carbon monoxide.

Platinum is a particularly preferred metal for use in the present method. When the metal is used in association with circulating particulate solids, the total amount of platinum used in an FCC system with respect to the circulating particulate solids inventory is between about 0.01 to 100 per million, by weight, with an amount between about 0.1 and 10 parts per million being particularly preferred. It will be apparent that the concentration of platinum in promoted particles will be relatively greater when a relatively smaller proportion of promoted particles is used. The concentration of platinum in discrete promoted particles used in carrying out the invention is usually within the range from 0.01 weight percent to 1 weight percent. Preferably, the concentration of platinum in promoted particles is between 0.1 and 0.5 weight percent.

The amount of Group VIII noble metals other than platinum required to provide combustion catalytic activity equivalent to platinum is generally between about 2 times to 10 times higher total concentration, with respect to the particulate solids inventory, with preferably at least twice as much and more preferably at least 5 times as much of other Group VIII noble metals being used to provide an equivalent effect, relative to platinum.

The promoting metal, metals, or compound thereof, are preferably employed in an FCC system in association with discrete, promoted particulate solids, which are physically admixed with, and circulated in the particulate solids inventory in an FCC system with unpromoted catalyst particles. The promoted particulate solids, if wholly or partially different in composition from the catalyst particles aside from the presence or absence of the promoting metal, may be formed from any material which is suitable for circulation in an FCC system in admixture with the catalyst. Particularly suitable materials are the porous inorganic oxides, such as alumina, silica, zirconia, etc., or mixtures of two or more inorganic oxides, which may be amorphous, crystalline, or both, such as silica-alumina, natural and synthetic clays and the like, crystalline aluminosilicate zeolites, etc. Gamma-alumina is particularly good. The combustion-promoting metal or metal compound can be added to a particulate solid, such as catalyst particles or other particulate materials, to form a promoted particulate solid in any suitable manner, as by impregnation or ion exchange, or can be added to a precursor of a particulate solid, as, for example, by coprecipitation from an aqueous solution with an inorganic oxide precursor sol. The promoted particulate solids can then be formed into particles of a size suitable for use in an FCC system by conventional means, such as spray-drying, crushing of larger particles to the desired size, etc.

A promoted particulate solid which contains at least one metal or metal compound of the type specified above can, for example, be physically admixed with unpromoted FCC catalyst and the mixture can then be charged to an FCC system. The promoted particulate solids can optionally be added separately in the desired amount to an FCC unit already containing a substantial inventory of unpromoted or promoted FCC catalyst.

Substantially complete combustion or carbon monoxide and coke is preferably carried out in the cracking catalyst regenerator. Sufficient coke is preferably burned off the catalyst during regeneration to provide an average level of coke on regenerated catalyst of less than 0.2 weight percent, and preferably less than 0.1 weight percent. The carbon monoxide produced in the catalyst regenerator is preferably substantially all burned to carbon dioxide. The flue gas removed from the regenerator preferably has not more than 1000 parts per million, by volume, of CO therein, particularly preferably not more than 500 parts per million, by volume.

The amount of oxygen must be sufficient to burn the desired amount of coke and carbon monoxide, but must not substantially exceed that required to carry out the combustion step in the regenerator. Thus, sufficient oxygen must be introduced into the regeneration zone so that flue gas removed from the regeneration zone contains at least 1 volume percent molecular oxygen. This oxygen in the flue gas is termed "excess" oxygen. At least 1 volume percent excess oxygen is required in order to provide the high degree of coke and carbon monoxide burning required in the process.

Preferably, the catalyst regeneration zone includes at least one dense-phase bed of fluidized particulate solids (density greater than 10 pounds per cubic foot). Two or more dense beds may be employed if a plurality of regeneration chambers is used, as in staged regeneration. Preferably, substantially all the carbon monoxide generated in a dense-phase catalyst bed is burned to carbon dioxide in the dense-phase bed. It is also preferred to control the average temperature of dense-phase beds of solids in a regeneration zone so that the average temperature does not exceed 675° C. Dense-phase burning of the carbon monoxide generated in an FCC catalyst regenerator is indicated when the average temperature in a dilute phase above a dense-phase catalyst bed is only slightly different, or lower than, the average temperature in the dense phase.

The steam treatment of the combustion promoter may be carried out in any convenient manner. The promoter is maintained at a temperature of from 760° C. to 1100° C. during the steam treatment. The treatment may last for a period in the range of from about 2 hours to about 100 hours or more. Preferably the steam treatment may use steam alone or may use steam mixed with other gases, gas mixtures or vapors, such as nitrogen, oxygen, hydrogen, air or the like. The steam pressure (or partial pressure) is between about 1 atmosphere and 15 atmospheres. Preferably a stream of steam-containing gas is continuously passed through the combustion-promoter particles being treated and then removed from contact with the promoter. The steam treatment may be performed in a continuous-type or, preferably, a batch-type operation. Generally, the steam treatment may be performed in a conventional manner using steaming means well known to those skilled in the art.

EXAMPLE I

A sample of a combustion-promoter additive was obtained. Part of the sample was subjected to steam treatment prior to use in a cracking system. The promoter employed contained 0.2 weight percent platinum on a particulate alumina sized for use in FCC systems. According to the invention, the promoter was treated in a a muffle furnace at a temperature of 980° C. for 96 hours at a steam pressure of 1 atmosphere.

EXAMPLE II

The steam-treated promoter was compared with the untreated promoter, and with other promoters, by using them in a pilot plant-sized fluidized catalytic cracking operation. Conventional cracking conditions and feed were used in the cracking reactor section. The combustion activity of the various combustion-promoter samples was determined by measuring the $CO/CO_2$ volume ratio in the flue gas formed in the catalyst regenerator section. The $NO_x$-forming activity of the various combustion-promoter samples was determined by measuring the concentration of NO in the flue gas discharged from the catalyst regenerator. The results of the tests are shown in the attached FIGURE. Referring to the FIGURE, it is shown that, at the same $CO/CO_2$ volume ratio (i.e., the same degree of carbon monoxide combustion), the steam-treated sample of promoter, according to the invention, produced a very substantially smaller amount of NO (representative of $NO_x$). Thus, it is clear that steam treatment according to the invention provides a highly effective means for controlling the formation of $NO_x$ in a system using a combustion promoter without substantially decreasing the carbon monoxide combustion activity of the promoter.

The following illustrative embodiment describes a preferred embodiment of the operation of the present invention.

ILLUSTRATIVE EMBODIMENT

A conventional FCC system and equilibrium, zeolite-containing, cracking catalyst of a commercially available type are employed for cracking about 20 M barrels per day of a hydrocarbon fresh feed having a boiling range of about 290° C. to about 565° C. and a heavy cycle oil recycle of about 5 M B/D having a boiling range of 260°–425° C. The cracking zone used employs a combination of riser cracking and dense-bed cracking modes. Cracking conditions include a reactor temperature of about 495° C., a total hydrocarbon weight hourly space velocity of about 8 per hour and a conversion rate (defined as percent of feed converted to 221° C. and lighter components) of about 83%. The average amount of coke on spent catalyst is about 1.0 weight percent. The amount of carbon on regenerated catalyst is about 0.5 weight percent. The flue gas exiting the catalyst regenerator includes about 0.3 volume percent oxygen, and has a $CO/CO_2$ ratio of about 1.28. Catalyst regeneration conditions used in the regeneration zone include a temperature of about 652° C. Catalyst is circulated continuously between the cracking zone and regeneration zone at the rate of about 14.8 metric tons/min, with a total catalyst inventory in the system of about 159 metric tons. The level of conversion in the system is found to be 83 volume percent. For comparison, 13.6 kg of commercial combustion-promoter particles containing 0.2 weight percent platinum impregnated on an alumina carrier are introduced into the regenerator of the FCC unit in one dump. Introduction of the platinum-alumina particles is then continued at the rate of about 2.5 kg per metric ton of fresh cracking catalyst. The amount of platinum added to the system is thereby maintained at an equilibrium level of about 3.1 parts per million, by weight, with respect to the total amount of catalyst in the system. Most of the carbon monoxide is burned in a vapor-phase portion of a dense-catalyst-phase region in the regenerator. A sufficient amount of oxygen is added to the regenerator to provide 1.5 volume percent oxygen in the regenerator atmosphere, as determined by measuring the oxygen content of flue gas leaving the regenerator. The temperature of the dense-phase region in the regenerator is maintained at 652°±5.5° C. A sufficient amount of coke is burned off the catalyst in the regenerator so that the carbon content of the regenerated catalyst passed from the regenerator to the reactor is only about 0.08 weight percent. After addition of the platinum-alumina carbon-monoxide-combustion promoter particles, the $CO/CO_2$ ratio in the flue gas exiting the regeneration zone is measured. The $CO/CO_2$ volume ratio is found to be substantially reduced, to below 0.002. The level of conversion in the cracking reactor is found to have increased to 86 volume percent. The amount of NO in the flue gas is measured and is found to be 520 parts per million, by volume. According to the invention, the same platinum-alumina combustion promoter is subjected to a steam treatment for 96 hours at 982° C. and a steam pressure of 1 atmosphere. An identical amount of the steam-treated promoter is then used in the same FCC system under the same operating conditions under which the untreated promoter has been used. The $CO/CO_2$ volume ratio in the flue gas is again measured, and is found to be below 0.09 while the amount of NO in the flue gas is measured and is found to be only 28 parts per million, i.e., a substantial reduction from that produced by the untreated combustion promoter.

As can be seen from the foregoing examples and illustrative embodiment, the method of the present invention provides a simple and economical way to reduce the nitrogen oxides level in regenerator flue gas in a complete-combustion-type FCC system, while maintaining the desired low level of coke on regenerated catalyst and high conversion. A large number of variations, modifications and equivalents of the embodiment set forth will be apparent to those skilled in the art and these equivalents and adaptations are intended to be included within the scope of the appended claims.

What is claimed is:

1. A process for cracking hydrocarbons in the absence of externally supplied molecular hydrogen comprising:

(1) contacting steam with a carbon monoxide combustion promoter comprising a combustion-promoting metal or compound of a metal selected from platinum, palladium, iridium, osmium, ruthenium, rhodium, rhenium and copper associated with at least one particulate porous inorganic solid at a temperature of 760° C. to 1100° C. and a steam pressure of 1 atmosphere to 15 atmospheres for a period of from 2 hours to 100 hours;

(2) cycling particulate cracking catalyst between a cracking zone and a catalyst regeneration zone, in a catalytic cracking system;

(3) cracking said hydrocarbons in contact with said catalyst at cracking conditions in said cracking zone whereby coke is formed on said catalyst; and (4) burning coke off said catalyst with an oxygen-containing and nitrogen-containing gas at regeneration conditions in said regeneration zone in the presence of said combustion promoter.

2. A method according to claim 1 wherein said metal comprises platinum.

3. A method according to claim 1 wherein said particulate porous inorganic solid includes at least one of alumina and silica.

4. A method for restricting the formation of nitrogen oxides in a hydrocarbon cracking catalyst regeneration zone wherein carbon monoxide is combusted with a molecular oxygen-containing and molecular nitrogen-containing gas in contact with a carbon monoxide combustion promoter including a combustion-promoting metal or compound metal selected from platinum, palladium, iridium, osmium, ruthenium, rhodium, rhenium and copper associated with at least one particulate porous inorganic solid, comprising:

contacting said combustion promoter with steam at a temperature of 760° C. to 1100° C. and a steam pressure of 1 atmosphere to 15 atmospheres for a period of from 2 hours to 100 hours.

5. A method according to claim 4 wherein said metal comprises platinum.

6. A method according to claim 4 wherein said particulate porous inorganic solid includes at least one of alumina and silica.

* * * * *